US008727196B2

(12) United States Patent
Morishita

(10) Patent No.: US 8,727,196 B2
(45) Date of Patent: May 20, 2014

(54) FEEDER APPARATUS FOR METAL STRIP

(75) Inventor: Keiichi Morishita, Tokyo (JP)

(73) Assignee: Hidaka Seiki Kabushiki Kaisha, Tokyo (JP)

( * ) Notice: Subject to any disclaimer, the term of this patent is extended or adjusted under 35 U.S.C. 154(b) by 536 days.

(21) Appl. No.: 13/079,096

(22) Filed: Apr. 4, 2011

(65) Prior Publication Data

US 2012/0085805 A1 Apr. 12, 2012

(30) Foreign Application Priority Data

Oct. 8, 2010 (JP) ..... 2010-228199

(51) Int. Cl.
*B65H 20/22* (2006.01)
*B21D 43/06* (2006.01)

(52) U.S. Cl.
USPC ..... 226/55; 226/67; 226/147; 226/158; 226/165

(58) Field of Classification Search
USPC ..... 226/6, 8, 55–58, 67, 147, 158, 165
See application file for complete search history.

(56) References Cited

U.S. PATENT DOCUMENTS 2,468,620 A * 4/1949 Gilbert ..... 83/244
3,756,491 A * 9/1973 Moriyama et al. ..... 226/67
3,900,257 A * 8/1975 Woolley et al. ..... 355/29
4,385,718 A 5/1983 Norris
4,523,449 A * 6/1985 Moriyama et al. ..... 72/421
4,798,649 A * 1/1989 Ross ..... 156/552
2004/0040998 A1 3/2004 Chon

FOREIGN PATENT DOCUMENTS

CN 1478708 A 3/2004
CN 2663051 Y 12/2004
CN 1891449 A 1/2007
JP 5-43094 A 2/1993
JP 11-192600 A 7/1999
JP 3881991 B2 2/2007

* cited by examiner

*Primary Examiner* — Sang Kim
*Assistant Examiner* — Scott Haugland
(74) *Attorney, Agent, or Firm* — Birch, Stewart, Kolasch & Birch, LLP

(57) ABSTRACT

A feeder apparatus for a metal strip includes: a reciprocating block reciprocally moved by a driving means of a press apparatus when conveying the metal strip in which through-holes are formed in a predetermined direction; a moving block disposed above the reciprocating block and connected to a connecting member that moves in the direction of movement of the reciprocating block; a pin block that moves with the moving block and is provided with conveying pins whose front ends are inserted inside the through-holes; and an upper-lower cam portion that raises and lowers the pin block. The moving block is not pulled by the reciprocating block, and the feeder apparatus further includes a moving block driving means for reciprocally moving the moving block separately to movement of the reciprocating block.

5 Claims, 16 Drawing Sheets

FEEDER APPARATUS FOR METAL STRIP

CROSS-REFERENCE TO RELATED APPLICATION(S)

This application is based upon and claims the benefit of priority of the prior Japanese Patent Application No. 2010-228199, filed on Oct. 8, 2010, the entire contents of which are incorporated herein by reference.

FIELD

The present invention relates to a feeder apparatus that feeds a metal strip, in which a plurality of through-holes have been formed at predetermined intervals in a feeding direction, in a predetermined direction.

BACKGROUND

A heat exchanger, such as an air conditioner, is constructed by stacking a plurality of heat exchanger fins in which a plurality of through-holes have been formed to enable heat exchanger tubes to be inserted. Such heat exchanger fins are manufactured by a manufacturing apparatus for heat exchanger fins depicted in FIG. 14. The manufacturing apparatus for heat exchanger fins is equipped with an uncoiler 12 where a thin metal plate (or "metal strip") 10 made of aluminum or the like has been wound into a coil. The metal strip 10 pulled out from the uncoiler 12 via pinch rollers 14 is inserted into an oil applying apparatus 16 where machining oil is applied onto the surface of the metal strip 10, and is then supplied to a mold apparatus 20 provided inside a press apparatus 18.

The mold apparatus 20 internally includes an upper mold die set 22 that is capable of up-down movement and a lower mold die set 24 that is static. A plurality of collar-equipped through-holes 11 (sometimes referred to simply as "through-holes" in this specification), where collars of a predetermined height are formed around through-holes that have been formed, are formed at predetermined intervals in a predetermined direction in the metal strip 10 that has passed the mold apparatus 20. After being conveyed a predetermined distance in the predetermined direction, the metal strip 10 is cut into predetermined lengths by a cutter 28 and is then stored in a stacker 28.

The press apparatus 18 is equipped with a feeder apparatus that intermittently conveys the metal strip 10 in which the plurality of through-holes 11 have been formed at predetermined intervals in the predetermined direction toward the cutter 26.

Conveying of the metal strip 10 by operation of the feeder apparatus will now be described with reference to FIGS. 15 and 16. The feeder apparatus inserts feeder pins 68 into the through-holes 11 formed in the metal strip 10 from below and moves the feeder pins 68 in a feeding direction to convey the metal strip 10 in the conveying direction.

The metal strip 10 is placed on a reference plate 64. Slits 66 that extend over the range of movement of the feeder pins 68 are formed in the reference plate 64. The feeder pins 68 protrude upward from the slits 66.

The feeder pins 68 are provided so as to protrude upward on a pin block 56 that is capable of moving in the horizontal and up-down directions.

When the metal strip 10 is conveyed in the conveying direction, the pin block 56 is raised and the feeder pins 68 are inserted into the through-holes 11 of the metal strip 10 placed on the reference plate 64. The pin block 56 is then moved in the conveying direction. After the metal strip 10 has been moved to a predetermined position, the pin block 56 is lowered and the feeder pins 68 are withdrawn downward from the through-holes 11. After this, in a state where the feeder pins 68 are at a position that does not contact the metal strip 10, the pin block 56 moves in the opposite direction to the conveying direction (a "return direction") to return to an initial position.

Next, the detailed construction and operation of a conventional feeder apparatus will be described with reference to FIGS. 17 to 19.

The feeder apparatus includes a reciprocating block 50 that moves reciprocally in the feeding direction and a moving block 54 that is provided above the reciprocating block 50. The moving block 54 is fixed to a shaft 60 that is suspended so as to be movable in the same direction as the direction of movement of the reciprocating block 50 between two fixed members 82*a*, 82*b* that are fixed opposite one another near both end portions of the reciprocating block 50. This means that the moving block 54 is capable of moving together with the shaft 60 in the direction of movement of the reciprocating block 50.

The pin block 56 that holds the feeder pins 68 has two plates 56*a*, 56*b* that are provided above the moving block 54 and are disposed above and below one another. The pin block 56 is attached so that the plurality of feeder pins 68 are sandwiched between the plates 56*a*, 56*b*.

The pin block 56 is energized downward (toward the moving block 54) by energizing means such as a spring, not depicted. This means that the pin block 56 is capable of moving together with the moving block 54 and when an upward force acts upon the pin block 56 against the energizing force of the energizing means, the pin block 56 is raised toward the reference plate 64.

An upper-lower cam portion 80 is provided between the moving block 54 and the pin block 56. The upper-lower cam portion 80 is composed of an upper cam portion 76 that is fixed to the pin block 56 and a lower cam portion 78 provided on the moving block 54. Concave and convex portions are formed on respective opposing surfaces of the upper cam portion 76 and the lower cam portion 78.

The lower cam portion 78 is formed on an upper surface of a wide member 78*a* that is wider than the moving block 54 and is placed on the moving block 54 positioned between the fixed members 82*a*, 82*b*. The wide member 78*a* is formed with a suitable size so as to protrude out from both ends in the conveying direction beyond the moving block 54 and the pin block 56.

The concaves and convexes of the upper cam portion 76 are formed in a surface that is opposite the lower cam portion 78 of the wide member 78*a*.

The wide member 78*a* is capable of sliding above the moving block 54 with such movement of the wide member 78*a* being restricted by the fixed members 82*a*, 82*b*. That is, when the wide member 78*a* slides in the conveying direction, the conveying direction-side end portion of the wide member 78*a* contacts an inner wall surface of the fixed member 82*b* and when the wide member 78*a* slides in the opposite direction to the conveying direction, the end portion of the wide member 78*a* at the opposite end to the conveying direction of the metal strip 10 contacts an inner wall surface of the fixed member 82*a*.

As depicted in FIG. 19, when the conveying direction-side end portion of the wide member 78*a* contacts the fixed member 82*b*, the convexes respectively formed on the upper cam portion 76 and the lower cam portion 78 contact one another. This means that the pin block 56 is pressed upward against the energizing force of the energizing means and the front end portions of the feeder pins 68, 68 provided on the pin block 56 are inserted into the through-holes 11 of the metal strip 10 placed on the reference plate 64.

On the other hand, as depicted in FIGS. 17 and 18, when the wide member 78*a* slides in the conveying direction (i.e., toward the fixed member 82*b*) and the other end of the wide member 78*a* contacts the fixed member 82*a*, the convexes and concaves formed in the upper cam portion 76 and the lower cam portion 78 fit together. This means that the pin block 56 is pressed against the moving block 54 by the energizing force of the energizing means and the front end portions of the feeder pins 68, 68, . . . of the pin block 56 are withdrawn from the through-holes 11 of the metal strip 10 placed on the reference plate 64.

In this feeder apparatus for the metal strip 10, the metal strip 10 placed on the reference plate 64 is conveyed in the direction of the fixed block 52*b*, with positioning pins 84 for positioning the metal strip 10 at such position after conveying also being provided. The positioning pins 84 are provided so as to protrude upward from the fixed block 52*b*. The positioning pins 84 are moved up and down by a positioning cam portion 86 provided on the fixed block 52*b*.

The positioning cam portion 86 is composed of an upper cam portion 86*a* and a lower cam portion 86*b* that have convexes and concaves formed on respective opposing surfaces thereof that oppose one another, and the lower cam portion 86*b* is formed on a wide member 87 that is formed wider than the fixed block 52*b* and is capable of sliding.

When the lower cam portion 86*b* slides in the direction where the convexes of both cam portions become joined, the front end portions of the positioning pins 84 protrude above the reference plate 64 and are inserted inside through-holes 11 of the metal strip 10 placed on the reference plate 64, thereby positioning the metal strip 10.

On the other hand, when the lower cam portion 86*b* slides in a direction where the convexes and concaves of the cam portions fit together, the front end portions of the positioning pins 84 become positioned below the reference surface of the reference plate 64 and are withdrawn from the collar-equipped through-holes 11 of the metal strip 10 placed on the reference plate 64, thereby releasing the positioning of the metal strip 10.

The wide member 87 of the lower cam portion 86*b* is connected by a shaft 90 to a slide member 88 that is slidably inserted into a fixed block 52*a* that is opposite the fixed block 52*b*. The shaft 90 is disposed so as to extend between the two fixed blocks 52*a*, 52*b* disposed opposite one another along the conveying direction. The shaft 90 is disposed so as to pass through the reciprocating block 50 and is provided so as to not obstruct movement of the reciprocating block 50.

When the reciprocating block 50 has moved in the conveying direction, since the movement direction-side end portion of the reciprocating block 50 presses an end portion of the wide member 87 of the lower cam portion 86*b*, the lower cam portion 86*b* slides in a direction so that the convexes of the cam portions 86*a* and 86*b* become joined. When the reciprocating block 50 has moved in the opposite direction to the conveying direction, since the end portion of the reciprocating block 50 on the opposite side to the conveying direction presses an end portion of the slide member 88 provided on the opposite side of the shaft 90 to the side where the wide member 87 is provided, the lower cam portion 86*b* slides in a direction so that the concaves and convexes of the cam portions 86*a* and 86*b* fit together.

A movement operation of the moving block will now be described with reference to FIGS. 20 and 21. The moving block 54 is held in a center of the reciprocating block 50 by a spring, not depicted. Holding means 92 that reliably holds the moving block 54 at a predetermined position on the reciprocating block 50 is provided on the reciprocating block 50 so as to protrude from the reciprocating block 50. The holding means 92 has a pin member 98 that protrudes from the reciprocating block 50 toward the moving block 54 and whose front end portion engages the moving block 54. The holding means 98 is constructed so as to be capable of holding and releasing the moving block 54 in accordance with movement of the reciprocating block 50. Wheels 97 that rotate along the conveying direction are provided at a bottom end portion of the holding means 98 and the wheels 97 are constantly energized downward by an energizing means 95.

A cam member 96 with a trapezoidal portion that protrudes upward is disposed below the reciprocating block 50. A bottom end portion of the pin member 98 where the wheels 97 are provided contacts the surface of the cam member 96 due to the energizing force of the energizing means 95.

When the wheels 97 are positioned on the trapezoidal portion of the cam member 96, the front end portion of the pin member 98 is raised and is inserted into the concave of the moving block 54 so that the holding means 98 and the moving block 54 become engaged. After this, the holding means 92 can then reliably hold the moving block 54 at a predetermined position on the reciprocating block 50.

On the other hand, when the movement of the moving block 54 reaches a position near the final end, the wheels become positioned lower than the trapezoidal portion of the cam member 96 and the front end portion of the pin member 98 is withdrawn from the concave of the moving block 54, thereby releasing the engagement of the pin member 98 and the moving block 54.

Patent Document 1

Japanese Patent No. 3,881,991

SUMMARY

In a conveying apparatus with the construction described above, the pin member moves up and down due to the bottom end thereof riding up the trapezoidal portion of the cam member, and by connecting the pin member to the moving block in this way, the moving block becomes able to move in accordance with movement of the reciprocating block.

That is, the reciprocating block will already be moving before the moving block starts to move, and due to the moving block that was stationary suddenly starting to move at the same speed as the movement speed of the reciprocating block, sudden acceleration occurs when the moving block starts to move. During stopping on the other hand, since the moving block stops suddenly due to the side surface of the moving block contacting a stopper, sudden deceleration also occurs during stopping.

In this way, in the conventional feeder apparatus, the metal strip is conveyed by causing sudden acceleration and sudden deceleration of the moving block that moves the feeder pins. However, there is a problem in that in the conventional feeder apparatus where the metal strip that has the feeder pins inserted into the through-holes is conveyed by way of sudden acceleration and sudden deceleration, an extremely large load is applied to the metal strip that is used for products. In recent years in particular, metal strips have been made extremely thin, resulting in the risk of deformation and the like of products due to the application of a large load. With a conveying method that involves sudden acceleration and sudden deceleration, there is also the problem of poor feeding precision for the metal strip.

The present invention was conceived to solve the problems described above and aims to provide a feeder apparatus that is capable of conveying a metal strip without causing sudden acceleration or sudden deceleration.

A feeder apparatus according to the present invention conveys a metal strip, in which a plurality of through-holes have been formed, in a predetermined direction and includes: a reference plate having an upper surface on which the metal strip is placed and having slits that extend in a feeding direction of the metal strip and pass through the reference plate so as to connect the upper surface and a lower surface of the reference plate; a reciprocating block that is provided below the reference plate and is moved reciprocally in the feeding direction of the metal strip and an opposite direction to the conveying direction in parallel to the reference plate by a driving means; a moving block that is disposed above the reciprocating block and is connected to a connecting member disposed so as to be movable in a moving direction of the reciprocating block between a pair of fixed members composed of fixed members that are fixed opposite one another near both ends of the reciprocating block that are perpendicular to a direction of reciprocal movement; a pin block provided so as to be capable of moving together with the moving block and of moving up and down toward the reference plate, and on which feeder pins, whose front end portions are inserted into the through-holes of the metal strip placed on the reference plate, are provided; and an upper-lower cam portion composed of an upper cam portion fixed to the pin block and a lower cam portion provided on the moving block opposite the upper cam portion, wherein the upper-lower cam portion is operable when the reciprocating block moves in the feeding direction of the metal strip, to raise the pin block toward the reference plate so that the front end portions of the feeder pins proceed into the slits of the reference plate and are inserted into the through-holes of the metal strip placed on the reference plate, and is operable when the reciprocating block moves in the opposite direction to the feeding direction of the metal strip, to lower the pin block toward the moving block so that the front end portions of the feeder pins are withdrawn from through-holes of the metal strip placed on the reference plate, wherein the moving block is formed so as to not have a pull exerted thereupon by the reciprocating block that moves reciprocally, and the feeder apparatus further includes a moving block driving means for reciprocally moving the moving block separately to reciprocal movement of the reciprocating block.

By using the above construction, it is possible to prevent the moving block from moving in accordance with movement of the reciprocating block, so that the moving block becomes able to operate separately to the operation of the reciprocating block. This means that it is possible to prevent sudden acceleration and sudden deceleration due to the reciprocating block exerting a pull on the reciprocating block as in the background art, and also to reduce the load upon the metal strip.

The moving block driving means may include a cam that operates so as to press a side surface of the moving block and move the moving block in the feeding direction. With this construction, it is possible to control the movement of the moving block according to the shape of the cam.

The cam may be shaped so that a speed of the moving block immediately after the moving block starts moving in the feeding direction from an initial position gradually increases and the speed of the moving block gradually decreases before a final end position in the feeding direction is reached. With this construction, it is possible to move the moving block with gradual acceleration and gradual deceleration according to the shape of the cam, and therefore possible to reduce the load on the metal strip.

In addition, the cam may be a plate cam, and a cam follower that contacts both a circumferential edge of the cam and the side surface of the moving block may be provided between the cam and the moving block. With this construction, since the cam does not directly press the moving block, the operation of the cam can be carried out smoothly.

The feeder apparatus may further include an energizing unit for energizing the moving block from the final end position in the feeding direction toward the initial position, the energizing means being provided on a side surface of the moving block on an opposite side to the side surface contacted by the cam. With this construction, after the moving block has been moved by the cam to the final end position in the feeding direction, the moving block is moved back to the initial position by the energizing force of the energizing unit. That is, when the moving block returns from a final end position in the feeding direction to the initial position, the feeder pins are in a lowered position and there is no conveying of the metal strip. This means that no load is applied to the metal strip and this return operation has no relation to the positioning precision. Accordingly, an energizing means is sufficient for returning the moving block to the initial position, which means that the construction can be simplified and the cost can be reduced.

The feeder apparatus may further include a positioning pin, wherein when the reciprocating block moves in the feeding direction of the metal strip, a front end portion of the positioning pin is positioned below the upper surface of the reference plate and when the reciprocating block moves in the opposite direction to the feeding direction of the metal strip, the front end portion of the positioning pin is inserted into a through-hole of the metal strip placed on the upper surface of the reference plate to position the metal strip at a predetermined position. With this construction, when the reciprocating block moves in the opposite direction to the feeding direction, it is possible to have the metal strip remain stationary in the positioned state. This means that when the through-holes of the metal strip are conveyed to the next process and machining is carried out on the through-holes, it is not necessary to carry out another positioning operation to correct positional displacements or the like of the through-holes, which makes it possible to increase the machining speed.

According to the present invention, it is possible to convey a metal strip without sudden acceleration or sudden deceleration. This means it is possible to raise the feeding precision without an excessive load being applied to the metal strip that is being conveyed.

DESCRIPTION OF EMBODIMENT(S)

Figure 1:
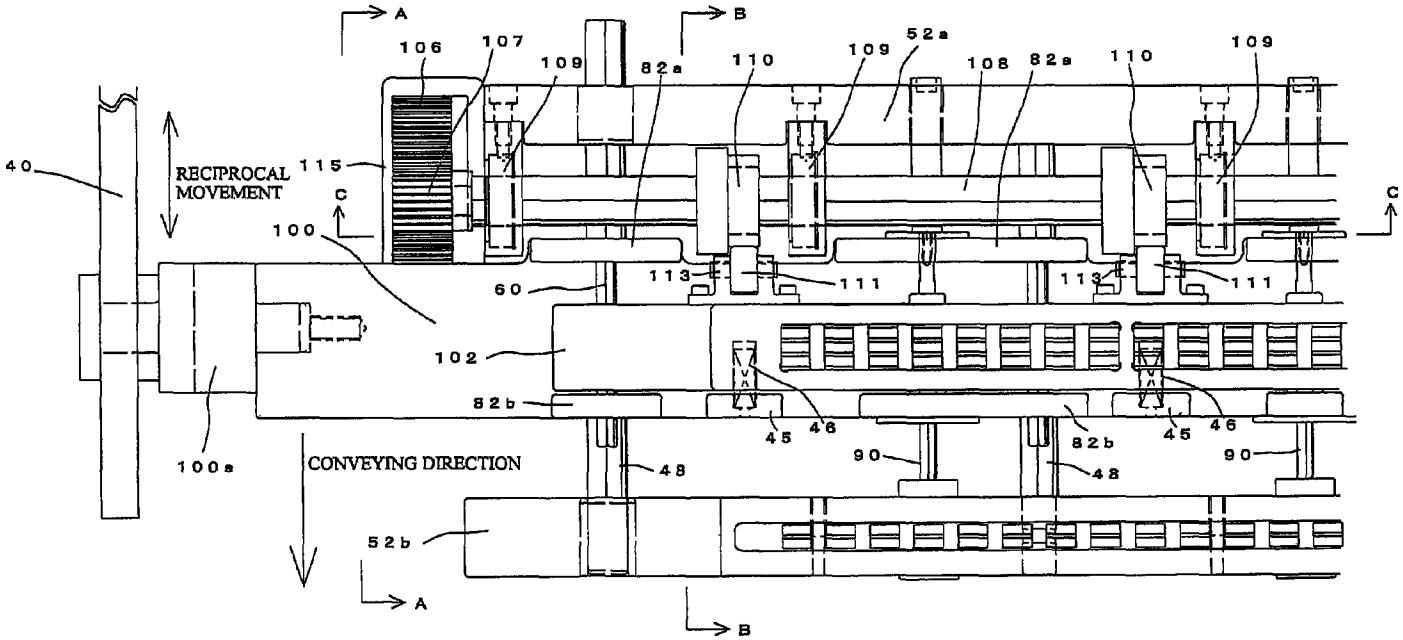
FIG. 1 is a plan view of a feeder apparatus for a metal strip according to the present invention.
Figure 2:
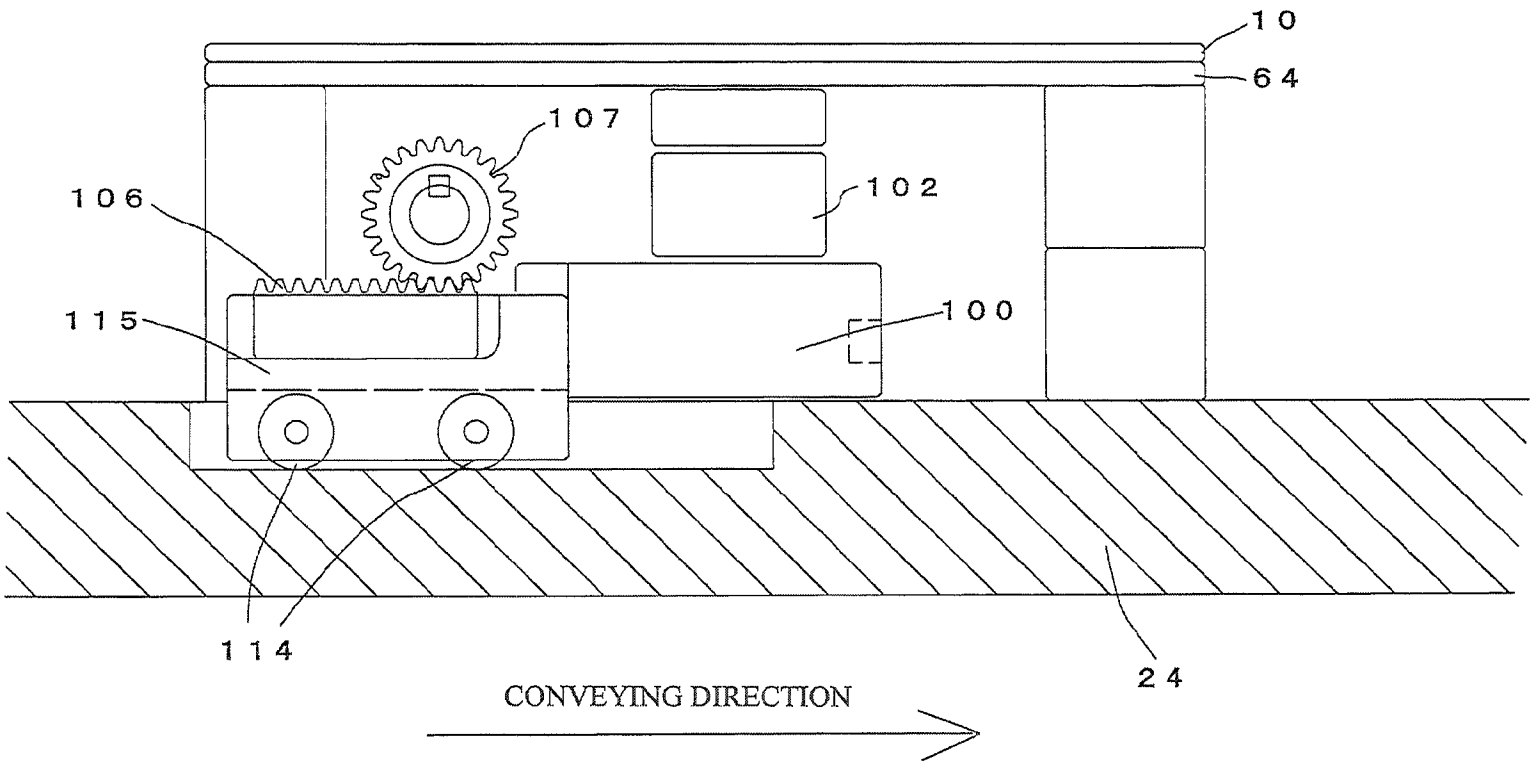
FIG. 2 is a side view of the feeder apparatus in FIG. 1 when looking from the direction A-A.
Figure 3:
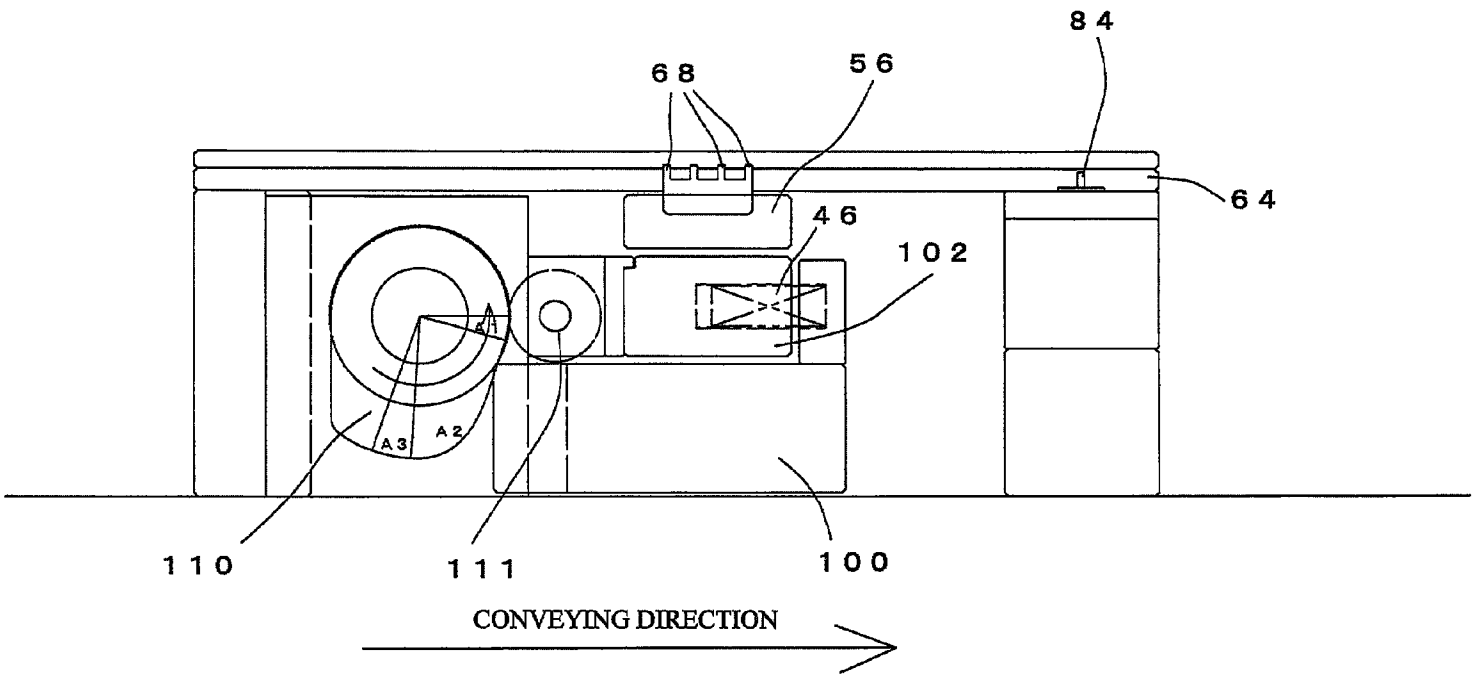
FIG. 3 is a side view of the feeder apparatus in FIG. 1 when looking from the direction B-B.
Figure 4:
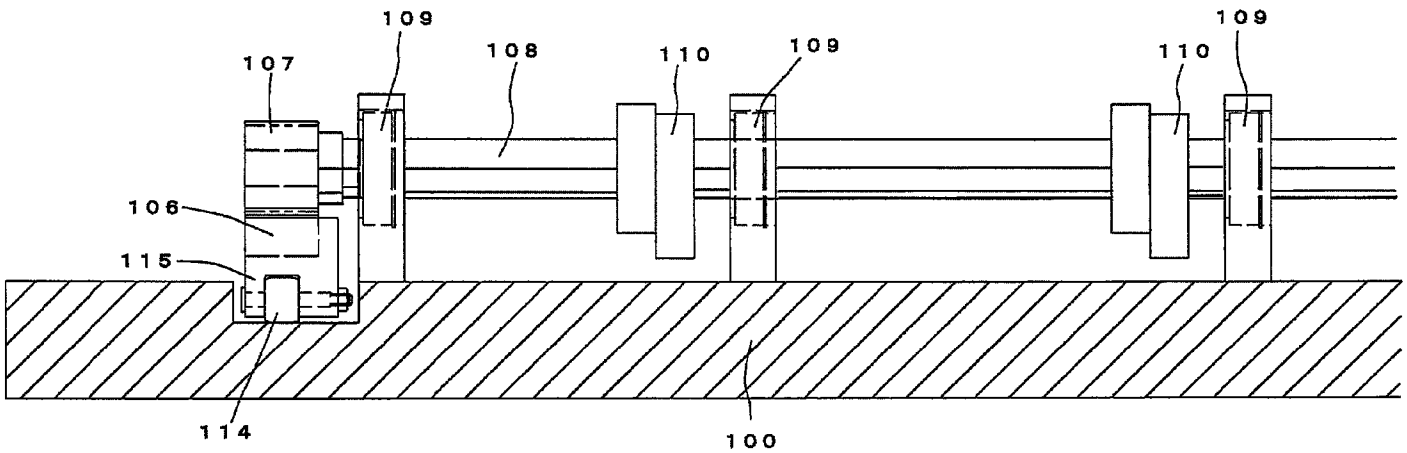
FIG. 4 is a front view of the feeder apparatus in FIG. 1 when looking from the direction C-C.
Figure 14:
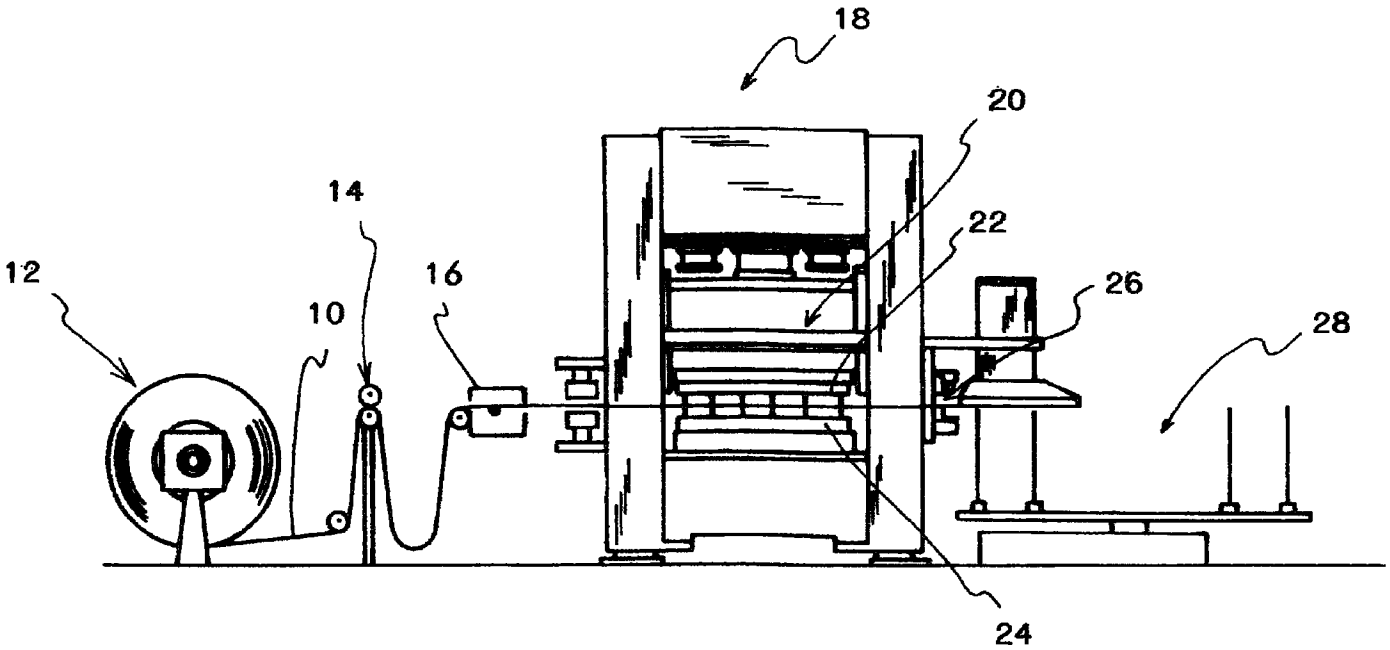
FIG.14 PRIOR ART
FIG. 14 is a diagram useful in explaining the overall construction of a manufacturing apparatus for heat exchanger fins.
Figure 15:
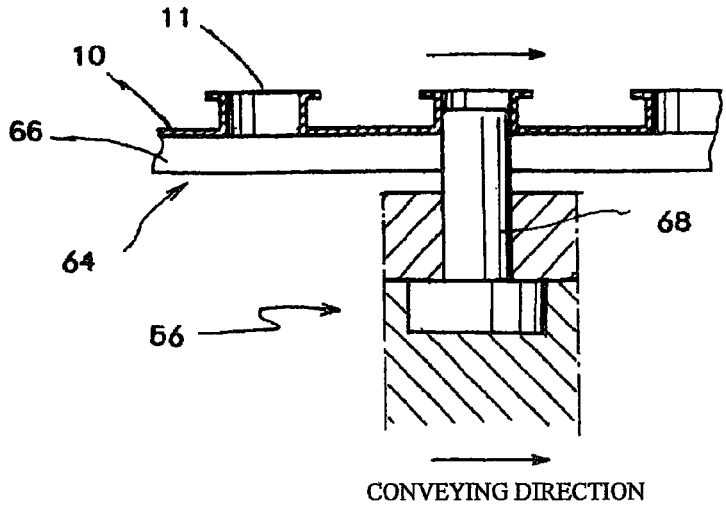
FIG.15 PRIOR ART
FIG. 15 is a diagram useful in depicting a state where a metal strip is being conveyed by feeder pins.
Figure 16:
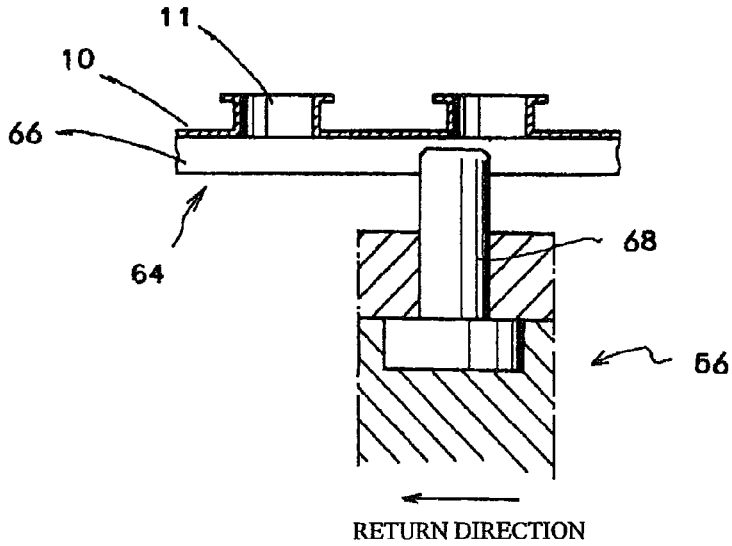
FIG.16 PRIOR ART
FIG. 16 is a diagram useful in depicting a state where the feeder pins return to the initial position after the metal strip has been conveyed.
Figure 17:
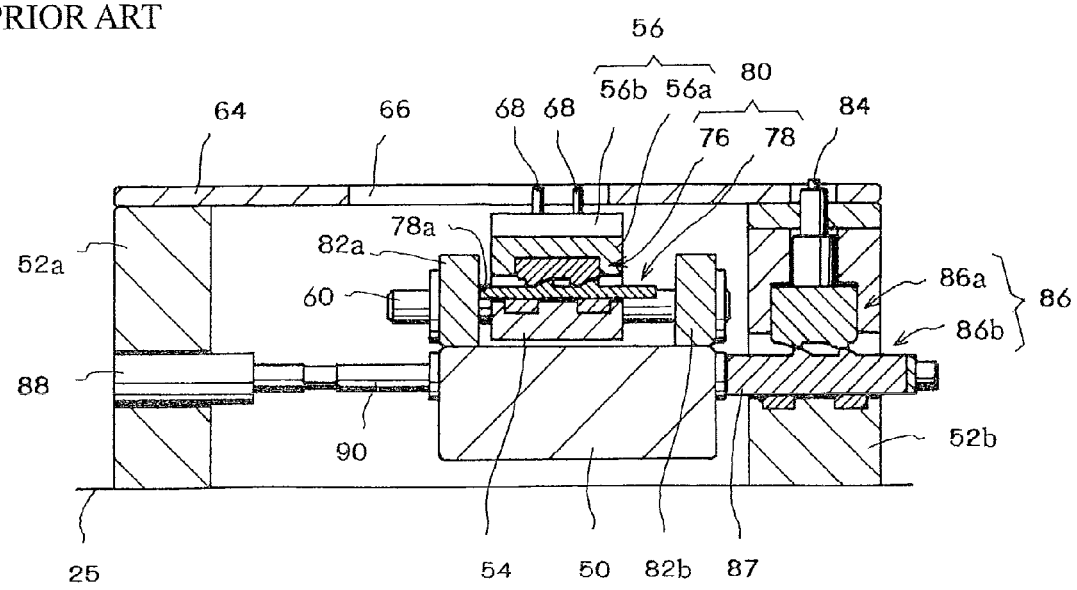
FIG.17 PRIOR ART
FIG. 17 is a diagram useful in depicting a construction for raising and lowering a pin block at a point where a moving block has reached a final end position and feeder pins have been lowered.
Figure 18:
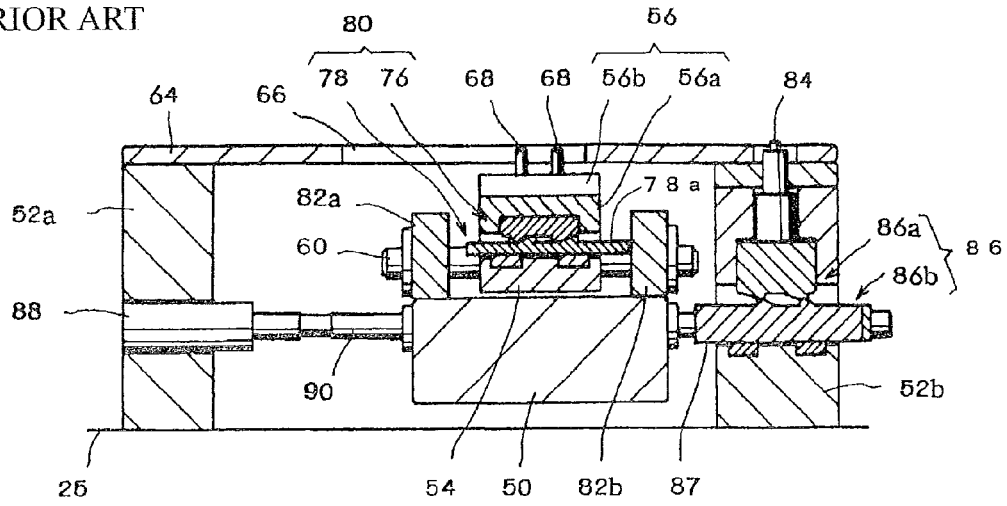
FIG.18 PRIOR ART
FIG. 18 is a diagram useful in depicting the construction in FIG. 17 at a point where the moving block is to be returned toward the initial position.
Figure 19:
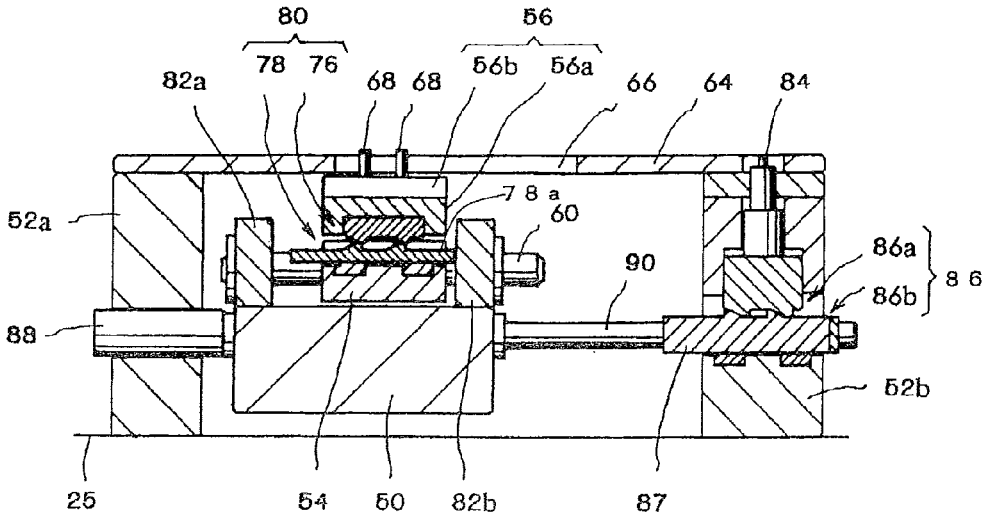
FIG.19 PRIOR ART
FIG. 19 is a diagram useful in depicting the construction in FIG. 18 at a point where the moving block has returned to the initial position.
Figure 20:
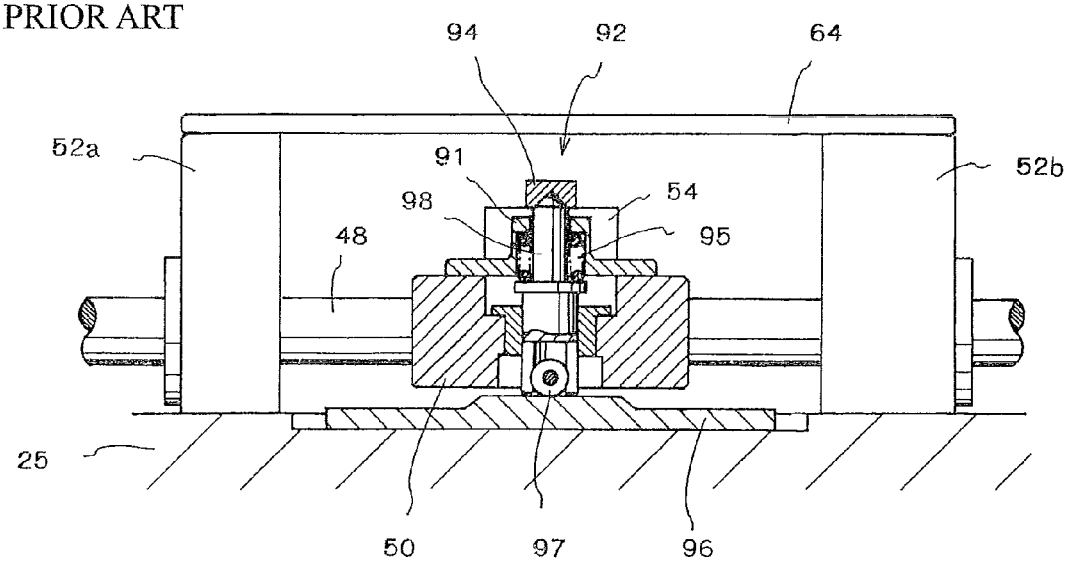
FIG.20 PRIOR ART
FIG. 20 is a diagram useful in depicting a conventional engagement structure for a moving block and a reciprocating block.
Figure 21:
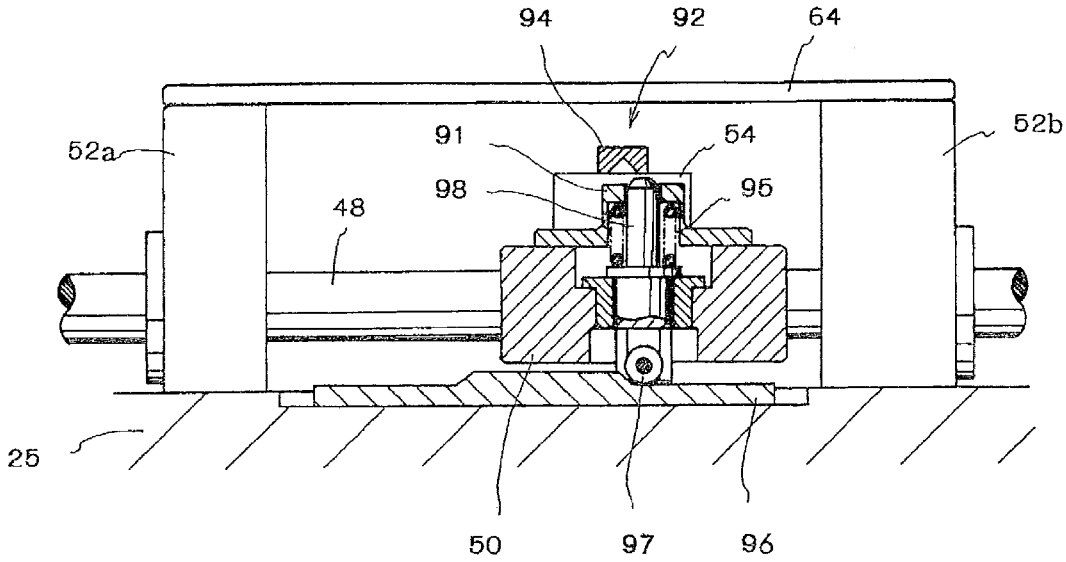
FIG.21 PRIOR ART
FIG. 21 is a diagram useful in depicting a state where the conventional engagement between the moving block and the reciprocating block is released.

Preferred embodiments of a feeder apparatus for a metal strip according to the present invention will now be described. FIG. 1 is a plan view of a feeder apparatus. FIG. 2 is a side view of the feeder apparatus in FIG. 1 when looking from the direction A-A, FIG. 3 is a side view of the feeder apparatus in FIG. 1 when looking from the direction B-B, and FIG. 4 is a front view of the feeder apparatus in FIG. 1 when looking from the direction C-C. A manufacturing apparatus for heat exchanger fins in which this feeder apparatus is provided is depicted in FIG. 14 that was described in the background art, and no further illustration is given here. Also, some component elements that are the same as component elements that were described for the background art have been assigned the same reference numerals and description thereof is omitted.

First, the overall operation of the feeder apparatus will be described. The feeder apparatus is an apparatus that inserts a plurality of feeder pins 68 into the through-holes 11 formed in the metal strip 10 and moves the feeder pins 68 to exert a pull on the metal strip 10 via the feeder pins 68 and thereby convey the metal strip 10 to a predetermined position. After the metal strip 10 has been pulled to the predetermined position, the feeder pins 68 are lowered to withdraw the feeder pins 68 from the through-holes 11 of the metal strip 10 and the feeder pins 68 return to an initial position.

The feeder apparatus includes a reciprocating block 100 and a moving block 102 that is provided above the reciprocating block 100. An upper end portion of a lever 40 that constructs a driving means is connected to a protruding portion 100*a* that protrudes from one end of the reciprocating block 100.

Figure 5:
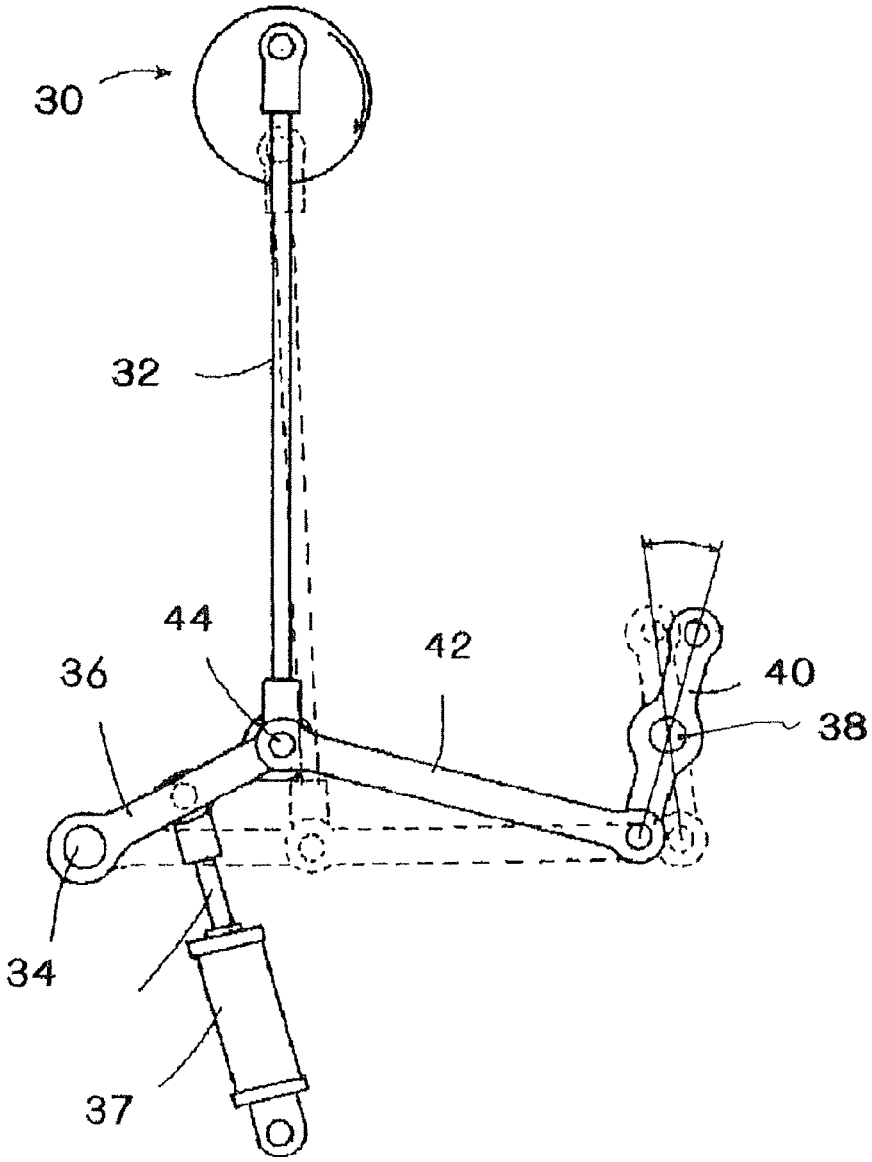
FIG. 5 is a diagram useful in depicting the construction of a driving means.

FIG. 5 depicts a driving means for driving the reciprocating block 100 of the feeder apparatus. The driving means connects a connecting rod 32 to an eccentric pin of a crank 30 that rotates in synchronization with the press apparatus 18, and connects a first link 36 that swings about a pin 34 and a second link 42 that is connected to a lever 40 that rotates about a fulcrum shaft 38 to a pin 44 at a lower end of the connecting rod 32. The first link 36 is equipped with a cylinder apparatus 37 that adjusts the swing angle of the first link 36. In this way, due to rotation of the crank 30 that is synchronized to the press apparatus 18, the connecting rod 32 moves the lever 40 reciprocally via the first link 36 and the second link 42.

Reciprocating Block

A rack gear 106 on which a gear is formed along the direction of reciprocal movement is provided on the reciprocating block 100. The rack gear 106 meshes with a pinion gear 107. Accordingly, due to the reciprocating block 100 reciprocally moving, the pinion gear 107 that meshes with the rack gear 106 rotates.

A rotational shaft 108 of the pinion gear 107 extends lengthwise via a plurality of bearings 109, with cams 110 that press the moving block 102 being provided on the rotational shaft 108. The cams 110 correspond to a "moving block driving means" that moves the moving block 102. That is, a rotational operation of the cams 110 is carried out in accordance with a rotational operation of the pinion gear 107. Note that since a rotational operation of the pinion gear 107 is carried out due to the reciprocal movement operation of the rack gear 106, the rotational operation of the cams 110 is composed of repeated rotation in a predetermined range (as described later, in a range of around 100°) based on reciprocal movement of the lever 40.

The rack gear 106 is disposed on an upper surface of a rack bearing 115 fixed to the reciprocating block 100. Rollers 114 for ensuring that the rack bearing 115 moves smoothly are provided on a lower part of the rack bearing 115.

Moving Block

The construction and operation of the moving block 102 will now be described.

The moving block 102 is disposed above the reciprocating block 100 and, in an operation that does not follow the reciprocal movement of the reciprocating block 100, reciprocally moves in the conveying direction of the metal strip 10. The movement operation of the moving block 102 is carried out due to the cams 110 fixed to the rotation shaft 108 of the pinion gear 107 pressing cam followers 111 held on an end surface of the moving block 102 on the opposite side to the conveying direction. The cams 110 are capable of rotating in keeping with rotation of the rotational shaft 108 of the pinion gear 107. The cam followers 111 are fixed so as to be freely rotatable on the opposite side end surface of the moving block 102 via rotational shafts 113 that extend in the same direction as the direction of the rotational shaft of the cams 110.

The moving block 102 is provided so that a shaft 60 passes through the moving block 102, the shaft 60 being suspended between two fixing members 82*a*, 82*b* provided so as to protrude upward at both end portions in the conveying direction of the reciprocating block 100. The shaft 60 corresponds to a "connecting member" mentioned in the patent claims. That is, the moving block 102 moves so as to be guided by the shaft 60 that is disposed along the conveying direction.

Final end wall portions 45 that protrude upward are provided at final end positions in the conveying direction of an upper surface of the reciprocating block 100. Energizing means 46 such as springs are provided between the final end wall portions 45 and the moving block 102 and the moving block 102 is constantly energized by the energizing means 46 toward an initial position.

Figure 6:
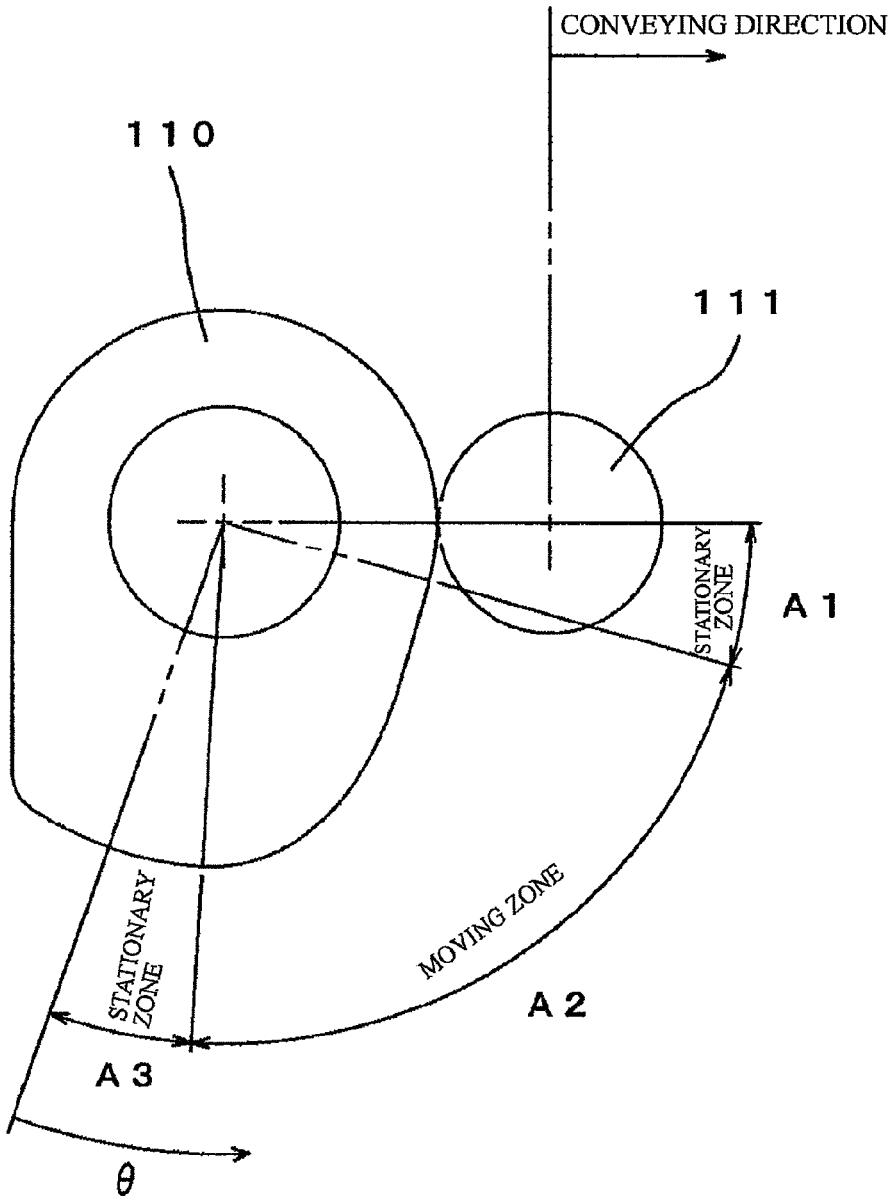
FIG. 6 is a diagram useful in depicting the shape of a cam and a cam follower.
Figure 7:
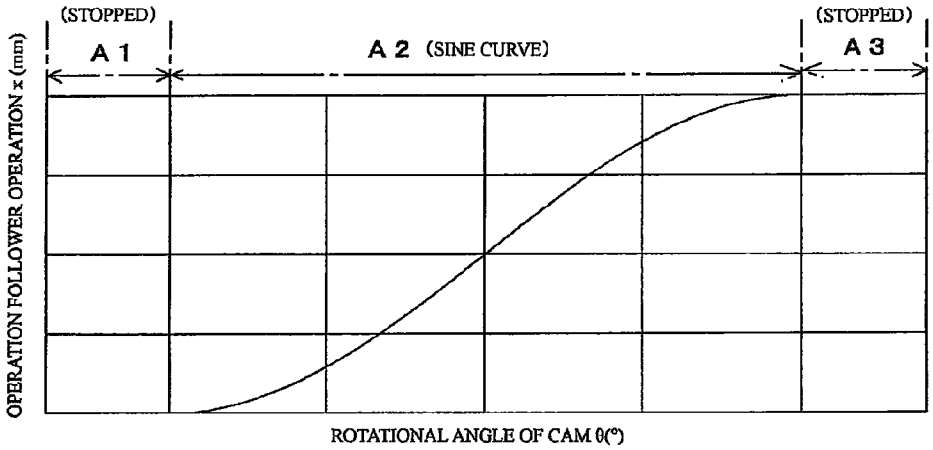
FIG. 7 is a graph depicting a relationship between the rotational angle of a cam and the distance moved by a cam follower.

FIG. 6 depicts one of the cams in plan view and FIG. 7 is a graph depicting the relationship between the distance moved by the moving block and the rotational angle of the cams.

Each cam 110 is positioned so that a circumferential end surface of a plate-like member, part of which is formed as a circle, contacts a cam follower 111, and when the side that protrudes outward from the rotation shaft 108 contacts the cam follower 111 due to rotation of the rotation shaft 108, the cam follower 111 is pressed in the conveying direction.

A first stationary zone A1 where the moving block 102 is stopped is formed on the circumferential end surface of each cam 110. The first stationary zone A1 is formed in an arc with a suitable radius of curvature so that the cam follower 111 is not pressed even when the cam 110 rotates. Following the first stationary zone A1, a moving zone A2 is formed on the circumferential end surface of the cam 110 so that the moving block 102 starts to move gradually with no sudden acceleration immediately after the start of movement from the initial position and so that the moving block 102 gradually accelerates thereafter. A part of the moving zone A2 near the final end is formed in a suitable shape so that the moving block 102 stops gradually toward the final end position without stopping suddenly. Following the moving zone A2, a second stationary zone A3 where the moving block 102 is stopped is formed on the circumferential end surface of the cam 110. The second stationary zone A3 is formed in an arc with a suitable radius of curvature so that the cam follower 111 is not pressed even when the cam 110 rotates.

The first stationary zone A1, the moving zone A2, and the second stationary zone A3 of each cam 110 are formed in a range (around 100°) through which the cam 110 rotates, and since other parts of the cam 110 do not contact the cam follower 111, such parts may be formed in any arbitrary shape. Note that when the first stationary zone A1 contacts the cam follower 111, the reciprocating block 100 will already be moving but the moving block 102 will not have started moving and will still be stationary. While the moving block 102 is stationary at this position, the feeder pins 68 are raised and the positioning pins 84 are lowered.

When the second stationary zone A3 contacts the cam follower 111, the reciprocating block 100 will still be moving but the moving block 102 will have already stopped. While the moving block 102 is stationary at this position, the feeder pins 68 are lowered and the positioning pins 84 are raised.

In this way, by providing the first stationary zone A1 and the second stationary zone A3, switching periods for the up-down positions of the respective pins are provided within the periods during which the moving block 102 is stationary.

As depicted in FIG. 7, the moving block 102 that moves in accordance with rotation of the cams 110 operates so that following a state where the moving block 102 is stopped, the position of the moving block 102 traces a sine curve relative to rotation of the cams 110, before stopping once again. That is, if the conveying direction is set as the plus (+) direction and the opposite direction to the conveying direction is set as the minus (−) direction, the moving block 102 moves off with gradually positive acceleration from the initial position until the moving block 102 starts to move and then gradually accelerates further before a maximum speed is reached at an intermediate position. After this, the moving block 102 decelerates from the intermediate position with a gradually increasing deceleration and as the moving block 102 approaches the final end position, the deceleration becomes more gradual as the moving block 102 stops.

In this way, by forming the shape of the cams 110 that press the moving block 102 so that no sudden acceleration or sudden deceleration is produced in the movement of the moving block 102, it is possible to reduce the load upon the metal strip 10 into which the feeder pins 68 provided on the moving block 102 have been inserted and to increase the feeding precision.

Operation of Feeder Pins

The raising and lowering of the feeder pins 68 in keeping with movement of the moving block 102 is the same as described for the background art, but will now be described again with reference to FIGS. 8 to 10.

The pin block 56 is provided above the moving block 102. The pin block 56 has two plates 56*a*, 56*b* provided above and below one another. The pin block 56 is attached so that the plurality of feeder pins 68 are sandwiched between the plates 56*a*, 56*b*.

The pin block 56 is energized downward (toward the moving block 102) by energizing means such as a spring, not depicted. The pin block 56 is capable of moving together with the moving block 102 and when an upward force acts upon the pin block 56 against the energizing force of the energizing means, the pin block 56 is raised toward the reference plate 64.

An upper-lower cam portion 80 is provided between the moving block 102 and the pin block 56. The upper-lower cam portion 80 is composed of an upper cam portion 76 that is fixed to the pin block 56 and a lower cam portion 78 provided on the moving block 54. Concave and convex portions are formed on respective opposing surfaces of the upper cam portion 76 and the lower cam portion 78. The upper cam portion 76 is provided with convexes and concaves that protrude downward on the lower portion of the pin block 56. The lower cam portion 78 is formed on an upper surface of a wide member 78*a* that is wider (i.e., longer in the conveying direction) than the moving block 102 and is formed so as to protrude out from both ends in the conveying direction beyond the moving block 102 and the pin block 56. That is, the concaves and convexes of the upper cam portion 76 and the concaves and convexes of the lower cam portion 78 are formed in opposing surfaces.

The wide member 78*a* is capable of sliding above the moving block 102 with such movement being restricted by the fixed members 82*a*, 82*b*. That is, when the wide member 78*a* slides in the conveying direction, the conveying direction-side end portion of the wide member 78*a* contacts an inner wall surface of the fixed member 82*b* and when the wide member 78*a* slides in the opposite direction to the conveying direction, the end portion of the wide member 78*a* at the opposite end to the conveying direction contacts an inner wall surface of the fixed member 82*a*.

Figure 10:
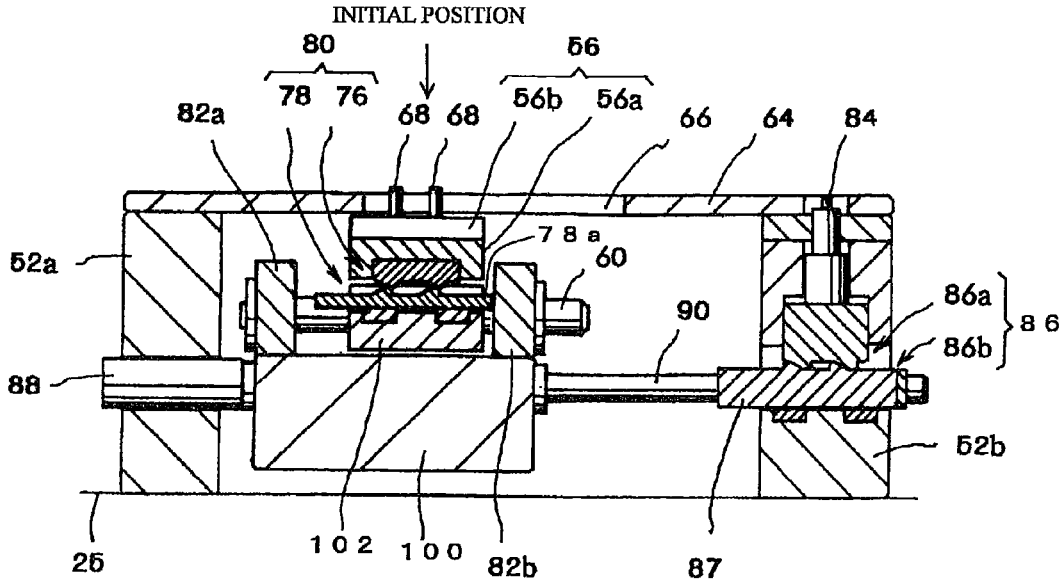
FIG. 10 is a diagram useful in depicting the construction in FIG. 9 at a point where the moving block has returned to the initial position.
Figure 11A:
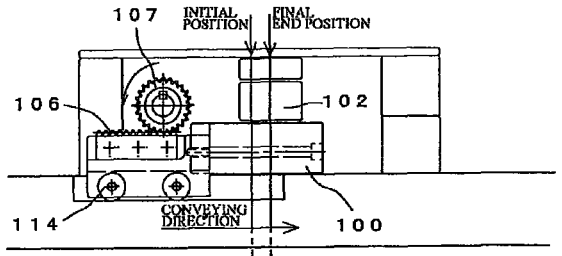
FIGS. 11A to 11E are diagrams useful in depicting movement of the reciprocating block in the conveying direction.
Figure 11B:
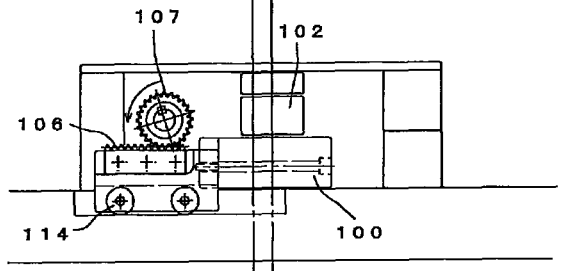
Figure 11C:
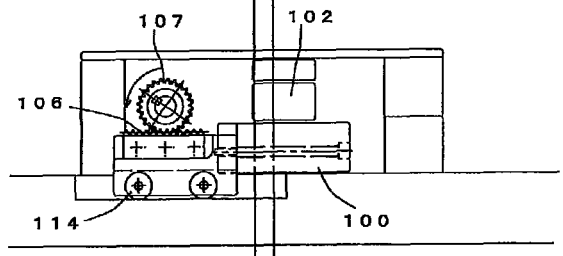
Figure 11D:
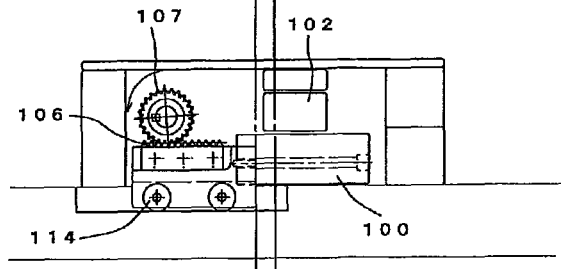
Figure 11E:
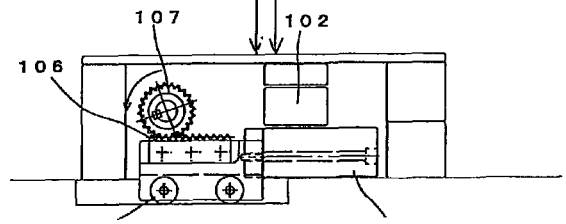

As depicted in FIG. 10, when the moving block 102 has returned to its initial position first and the reciprocating block 100 has subsequently returned to its initial position, the fixed member 82*b* contacts the conveying direction-side end portion of the wide member 78*a*. At this time, the convexes formed in the upper cam portion 76 and the lower cam portion 78 contact one another. This means that the pin block 56 is pressed upward against the energizing force of the energizing means and front end portions of the feeder pins 68, 68, . . . provided on the pin block 56 are inserted into the collar-equipped through-holes 11 of the metal strip 10 placed on the reference plate 64.

Figure 8:
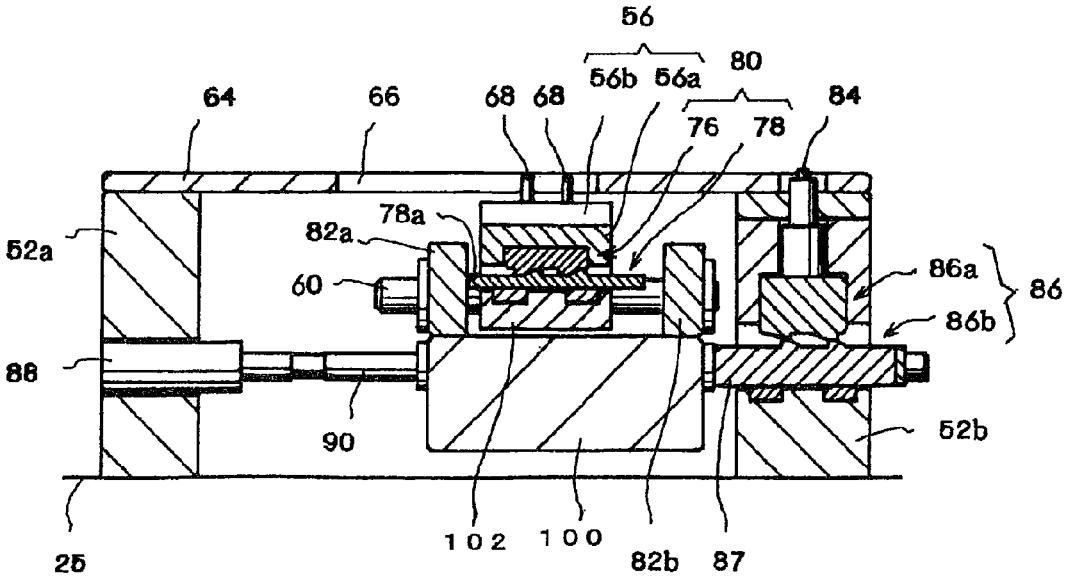
FIG. 8 is a diagram useful in depicting a construction for raising and lowering a pin block at a point where a moving block has reached a final end position and feeder pins have been lowered.
Figure 9:
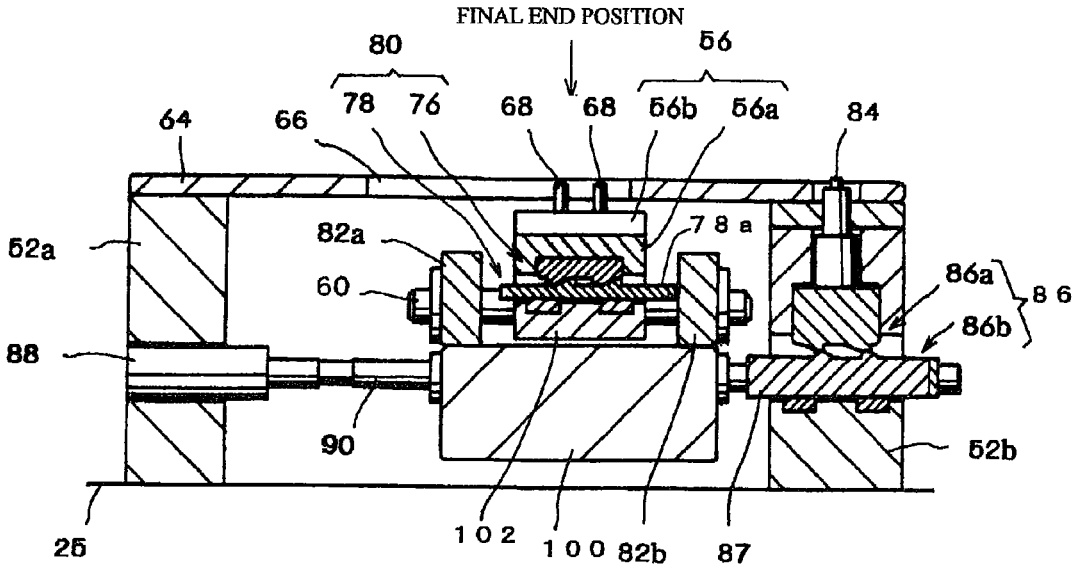
FIG. 9 is a diagram useful in depicting the construction in FIG. 8 at a point where the moving block is to be returned toward the initial position.

On the other hand, as depicted in FIG. 8, when the wide member 78*a* of the moving block 102 has slid in the conveying direction (the direction of the fixed member 82*b*) and reached the final end position, the reciprocating block 100 subsequently reaches the final end position. At this time, the fixed member 82*a* contacts the other end of the wide member 78*a* of the reciprocating block 100. When this happens, the concaves and the convexes formed in the upper cam portion 76 and the lower cam portion 78 fit together. This means that the pin block 56 is pressed onto the moving block 102 by the energizing force of the energizing means and the front end portions of the feeder pins 68, 68, . . . of the pin block 56 are withdrawn from below from the collar-equipped through-holes 11 of the metal strip 10 placed on the reference plate 64.

That is, when the moving block 102 has returned from the final end position in the conveying direction to the initial position, the pin block 56 is pressed upward so that the feeder pins 68 protrude upward and are inserted into the through-holes 11 of the metal strip 10 from below so that it becomes possible to convey the metal strip 10 using the feeder pins 68.

When the moving block 102 has moved to the final end position in the conveying direction, the pin block 56 is lowered, the feeder pins 68 are withdrawn downward from the through-holes 11 of the metal strip 10, and the conveying of the metal strip 10 ends.

Operation of Positioning Pins

The up-down movement of the positioning pins 84 in keeping with movement of the reciprocating block 100 is the same as described for the background art, but will now be described again with reference to FIGS. 8 to 10.

As described earlier, the metal strip 10 conveyed by the feeder pins 68 needs to be positioned at the conveyed-to position. For this reason, the positioning pins 84 are provided so as to be inserted into the through-holes 11 of the metal strip 10 after conveying has ended.

The positioning pins 84 are provided so as to protrude in the up/down direction from the fixed block 52*b*. The positioning pins 84 are raised and lowered by the positioning cam portion 86 provided on the fixed block 52*b*.

The positioning cam portion 86 is constructed of the upper cam portion 86*a* and the lower cam portion 86*b* that have concaves and convexes formed on respective opposing surfaces thereof that oppose one another, and the lower cam portion 86*b* is formed on the upper surface of the wide member 87 that is formed wider than the fixed block 52*b* and is capable of sliding.

When the lower cam portion 86*b* slides in the direction where the convexes of both cam portions become joined, the front end portions of the positioning pins 84 protrude above the reference plate 64 and are inserted inside collar-equipped through-holes 11 of the metal strip 10 placed on the reference plate 64, thereby positioning the metal strip 10.

On the other hand, when the lower cam portion 86*b* slides in a direction where the convexes and concaves of the cam portions fit together, the front end portions of the positioning pins 84 become positioned below the reference surface of the reference plate 64 and are withdrawn from the collar-equipped through-holes 11 of the metal strip 10 placed on the reference plate 64, thereby releasing the positioning of the metal strip 10.

The wide member 87 of the lower cam portion 86*b* is coupled by a shaft 90 to a slide member 88 that is slidably inserted into the fixed block 52*a* that is opposite the fixed block 52*b*. The shaft 90 is disposed so as to extend between the two fixed blocks 52*a*, 52*b* disposed opposite one another along the conveying direction. The shaft 90 is disposed so as to pass through the reciprocating block 100 and is provided so as to not obstruct movement of the reciprocating block 100.

When the reciprocating block 100 has moved in the conveying direction and reached the final end position, since the movement direction-side end portion of the reciprocating block 100 presses an end portion of the wide member 87 of the lower cam portion 86*b*, the lower cam portion 86*b* slides in a direction so that convexes of the cam portions 86*a* and 86*b* become joined.

When the reciprocating block 100 has moved in the opposite direction to the conveying direction, since the end of the reciprocating block 100 on the opposite side to the conveying direction presses the end portion of the slide member 88 on the opposite side to the side where the wide member 87 of the shaft 90 is provided, the lower cam portion 86*b* slides in a direction so that the concaves and convexes of the cam portions 86*a* and 86*b* fit together.

In this way, due to the reciprocal movement of the reciprocating block 100, when the reciprocating block 100 has reached the final end position in the conveying direction, the positioning pins 84 are inserted into the through-holes 11 of the metal strip 10 to position the metal strip 10 and when the reciprocating block 100 has returned to the initial position, the positioning pins 84 are withdrawn from the through-holes 11 of the metal strip 10 to release the positioning.

Overall Operation

FIGS. 11A to 11E depict a time series for movement of the reciprocating block 100 in the conveying direction.

As depicted in FIGS. 11A to 11E, by moving the lever 40 in the conveying direction, the reciprocating block 100 moves from the initial position to the final end position. The rack gear 106 moves in the horizontal direction in keeping with movement of the reciprocating block 100. The pinion gear 107 that meshes with the rack gear 106 rotates about the rotation shaft 108 in keeping with the movement of the rack gear 106.

On the other hand, due to rotation of the pinion gear 107, the cams 110 provided on the same shaft as the pinion gear 107 also rotate. Although the reciprocating block 100 is directly operated by the lever 40, the moving block 102 is operated not by the operation of the lever 40 but by the cams 110.

FIGS. 12A to 12E and FIGS. 13A to 13E depict up-down movement operations of the feeder pins and the positioning pins based on movement operations of the reciprocating block and the moving block in a time series.

Figure 12A:
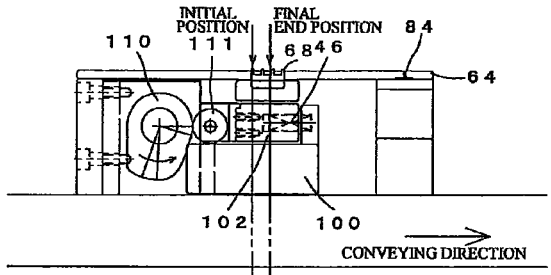
FIGS. 12A to 12E are diagrams useful in depicting movement of the moving block in the conveying direction based on rotation of the cams.
Figure 13A:
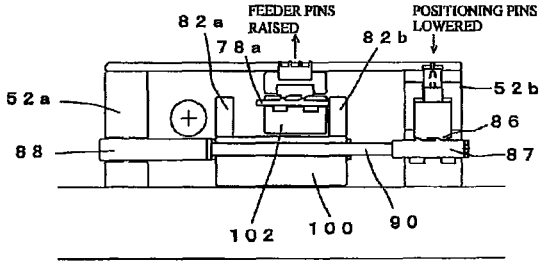
FIGS. 13A to 13E are diagrams useful in depicting up-down movement of the feeder pins and the positioning pins based on movement of the moving block and movement of the reciprocating block.

FIG. 12A and FIG. 13A depict a state where the moving block 102 is at a position (initial position) where the feeder pins 68 are raised. At this time, the reciprocating block 100 starts to move in the conveying direction due to the operation of the lever 40. Even when the reciprocating block 100 starts to move and the cams 110 start to rotate, the cams 110 will contact the cam followers 111 at positions that are not shaped so as to push the cam followers 111. Accordingly, at this time, the moving block 102 does not start to move and remains stationary.

Note that at this point, the end portion on the conveying direction-side of the wide member 78*a* contacts the inner wall surface of the fixed member 82*b*, the pin block 56 is raised, and the feeder pins 68 are inserted into the through-holes 11. Also at this point, the end portion of the reciprocating block

100 on the opposite side to the conveying direction presses the end portion of the slide member 88 of the shaft 90 so that the positioning pins 84 are lowered.

Figure 12B:
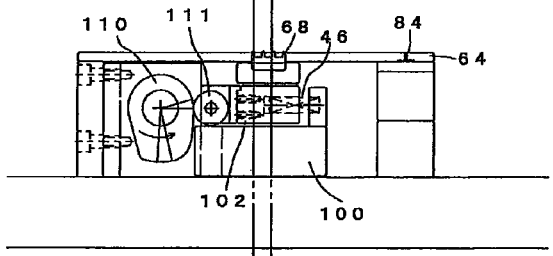
Figure 13B:
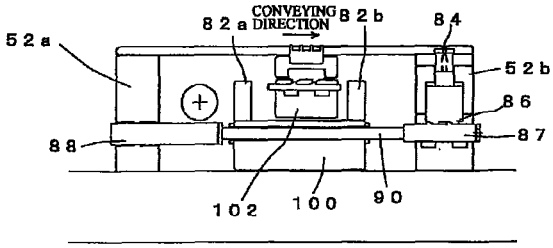

FIG. 12B and FIG. 13B depict a state where the moving block 102 starts moving due to rotation of the cams 110.

Figure 12C:
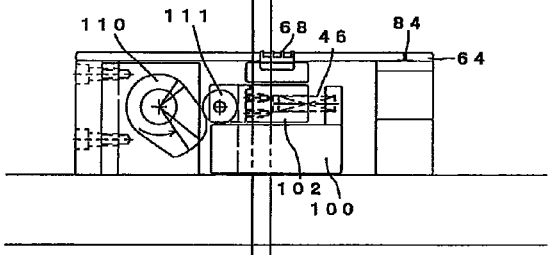
Figure 13C:
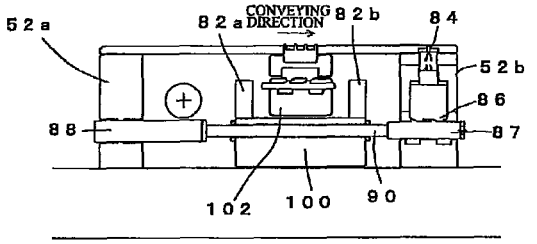

FIG. 12C and FIG. 13C depict an intermediate position during the movement stroke of the moving block 102.

Figure 12D:
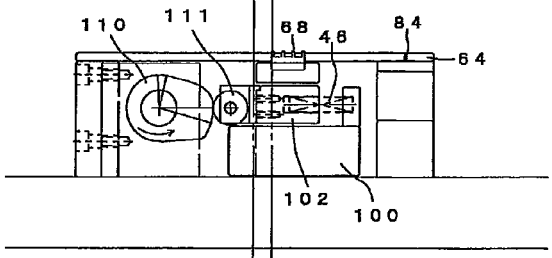
Figure 13D:
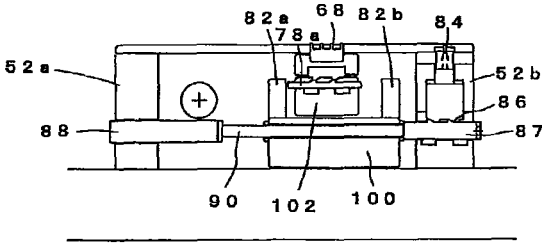

FIG. 12D and FIG. 13D depict a state where the moving block 102 has reached the final end position and has stopped.

Figure 12E:
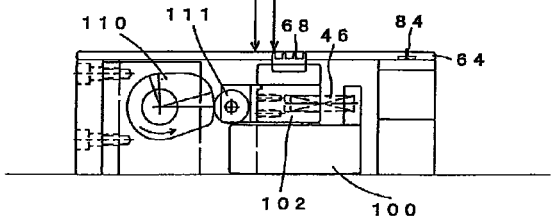
Figure 13E:
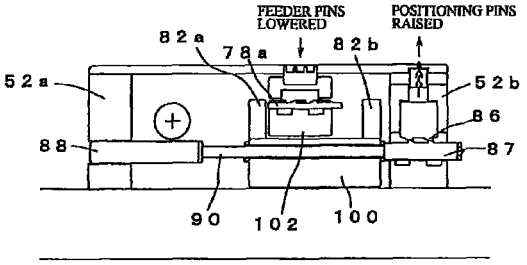

FIG. 12E and FIG. 13E depict a state where, after the moving block 102 has stopped, the reciprocating block 100 has moved further and then stopped. At this point, the end portion of the wide member 78*a* at the opposite end to the conveying direction contacts the inner wall surface of the fixed member 82*a*, the pin block 56 is lowered, and the feeder pins 68 are withdrawn downward from the through-holes 11. Also, at this point, the conveying direction-side end portion of the reciprocating block 100 presses the end portion of the wide member 87 of the shaft 90 to raise the positioning pins 84 and carry out positioning.

Note that when returning from the state depicted in FIG. 12E and FIG. 13E to the state depicted in FIGS. 12A and 13E, the reciprocating block 100 moves due to a reciprocating operation of the lever 40 and the moving block 102 moves due to the energizing force of the energizing means 46.

Other Embodiments

Although an example where the moving block 102 moves so that a position thereof with respect to the rotation of the cams 110 traces a sine curve has been described in the above embodiment, provided that sudden acceleration and sudden deceleration do not occur, the moving block 102 does not need to move so as to trace a sine curve Also, in the embodiment described above, an example is described where the force that returns the moving block 102 to the initial position when the moving block 102 has reached the final end position in the conveying direction is provided by the energizing force of the energizing means 46. The feeder pins 68 are lowered when the moving block 102 returns to the initial position and therefore sudden acceleration and sudden deceleration may occur. This means that any means may be used as the driving means for returning the moving block 102 from the final end position to the initial position.

Although the present invention has been described above by way of the preferred embodiments, the present invention is not limited to such embodiments and it should be obvious that various modifications may be implemented without departing from the scope of the invention.

What is claimed is:

1. A feeder apparatus for conveying a metal strip, in which a plurality of through-holes have been formed, in a predetermined direction, the feeder apparatus comprising:

a reference plate having an upper surface on which the metal strip is placed and having slits that extend in a feeding direction of the metal strip and pass through the reference plate so as to connect the upper surface and a lower surface of the reference plate;

a reciprocating block that is provided below the reference plate and is moved reciprocally in a conveying direction of the metal strip and an opposite direction to the feeding direction in parallel to the reference plate by a driving means;

a shaft that is disposed above the reciprocating block and is suspended between a pair of fixing members being fixed opposite one another near both ends of the reciprocating block that are perpendicular to the directions of reciprocal movement;

a moving block, through which the shaft is passed, being capable of moving with respect to the reciprocating block;

a pin block provided so as to be capable of moving together with the moving block and of moving up and down toward the reference plate, and on which feeder pins, whose front end portions are inserted into the through-holes of the metal strip placed on the reference plate, are provided; and an upper-lower cam portion composed of an upper cam portion fixed to the pin block and a lower cam portion provided on the moving block opposite the upper cam portion, wherein the upper-lower cam portion is operable when the reciprocating block moves in the feeding direction of the metal strip, to raise the pin block toward the reference plate so that the front end portions of the feeder pins proceed into the slits of the reference plate and are inserted into the through-holes of the metal strip placed on the reference plate, wherein a cam reciprocally moves the moving block separately from the reciprocal movement of the reciprocating block, and operates so as to press a side surface of the moving block in the feeding direction, the cam is shaped so that a speed of the moving block immediately after the moving block starts moving in the feeding direction from an initial position gradually increases, and the speed of the moving block gradually decreases before a final end position in the feeding direction is reached, a rack gear on which a gear is formed along the direction of reciprocal movement is provided on the reciprocating block, and a pinion gear meshes with the rack gear and the cam that presses the moving block are provided on a rotational shaft.

2. A feeder apparatus for conveying a metal strip according to claim 1, wherein the cam is a plate cam, and a cam follower that contacts both a circumferential edge of the cam and the side surface of the moving block is provided between the cam and the moving block.

3. A feeder apparatus for conveying a metal strip according to claim 2, further comprising energizing means for energizing the moving block from the final end position in the feeding direction toward the initial position, the energizing means being provided between a final end wall portion that protrudes upward at a final end position of the reciprocating block and the moving block.

4. A feeder apparatus for conveying a metal strip according to claim 1, further comprising:

energizing means for energizing the moving block from the final end position in the feeding direction toward the initial position, the energizing means being provided between a final end wall portion that protrudes upward at a final end position of the reciprocating block and the moving block.

5. A feeder apparatus for conveying a metal strip according to claim 1, further comprising:

a positioning pin, wherein when the reciprocating block moves in the feeding direction of the metal strip, a front end portion of the positioning pin is positioned below the upper surface of the reference plate, and when the reciprocating block moves in the opposite direction to the feeding direction of the metal strip, the front end portion of the positioning pin is inserted into one of the through-holes of the metal strip placed on the upper surface of the reference plate to position the metal strip at a predetermined position.

* * * * *